US009487376B2

(12) United States Patent
Salentine et al.

(10) Patent No.: US 9,487,376 B2
(45) Date of Patent: Nov. 8, 2016

(54) RETRACTING DEVICE FOR MOUNTING TO A WEB STRAP

(71) Applicant: HAMMERHEAD INDUSTRIES, INC., Ventura, CA (US)

(72) Inventors: John A Salentine, Goleta, CA (US); Kenneth S Collin, Jr., Ojai, CA (US)

(73) Assignee: HAMMERHEAD INDUSTRIES, INC., Ventura, CA (US)

( * ) Notice: Subject to any disclaimer, the term of this patent is extended or adjusted under 35 U.S.C. 154(b) by 4 days.

(21) Appl. No.: 13/741,204

(22) Filed: Jan. 14, 2013

(65) Prior Publication Data

US 2013/0181083 A1 Jul. 18, 2013

Related U.S. Application Data

(60) Provisional application No. 61/587,047, filed on Jan. 16, 2012.

(51) Int. Cl.

| | |
|---|---|
| ***A45F 5/02*** | (2006.01) |
| ***B65H 75/48*** | (2006.01) |
| ***A45F 5/00*** | (2006.01) |

(52) U.S. Cl.

CPC ..... *B65H 75/48* (2013.01); *A45F 5/004* (2013.01); *A45F 5/02* (2013.01); *A45F 5/021* (2013.01)

(58) Field of Classification Search

CPC . B65H 75/406; B65H 75/4471; A45F 5/021; A45F 2005/025

USPC ..... 242/379, 379.2; 224/162, 197, 269, 224/666, 930

See application file for complete search history.

(56) References Cited

U.S. PATENT DOCUMENTS

| | | | | |
|---|---|---|---|---|
| 6,966,519 | B2 | 11/2005 | Salentine et al. | |
| 7,478,776 | B2 | 1/2009 | Salentine et al. | |
| 7,665,684 | B2 | 2/2010 | Salentine et al. | |
| 8,783,531 | B2 * | 7/2014 | Kroupa | 224/162 |
| 8,794,560 | B2 * | 8/2014 | Salentine et al. | 242/379.2 |
| 2003/0047575 | A1 * | 3/2003 | Enkerlin et al. | 224/271 |

* cited by examiner

*Primary Examiner* — Sang Kim

(74) *Attorney, Agent, or Firm* — Koppel, Patrick, Heybl & Philpott

(57) ABSTRACT

Retractors and vests having retractors are disclosed, wherein the retractor can be attached by an attachment mechanism to a web system on the vest. An accessory can be attached to a line within the retractor, and the line can be extended from the retractor housing during accessory use. When the line is extended from the housing, the retractor housing rotates so it aligns with the extended line. This alignment of the housing and line reduces stresses on the line, which extends the reliability and lifespan of the retractor. Further, a retraction force can retract the line back into the retractor housing when the extension force is released. The retraction force can be strong enough to prevent the line from extending from under weight of the accessory. The retractor can also minimize the dangle length of the retracting device to the attachment point to minimize movement when not in use.

19 Claims, 3 Drawing Sheets

FIG. 1
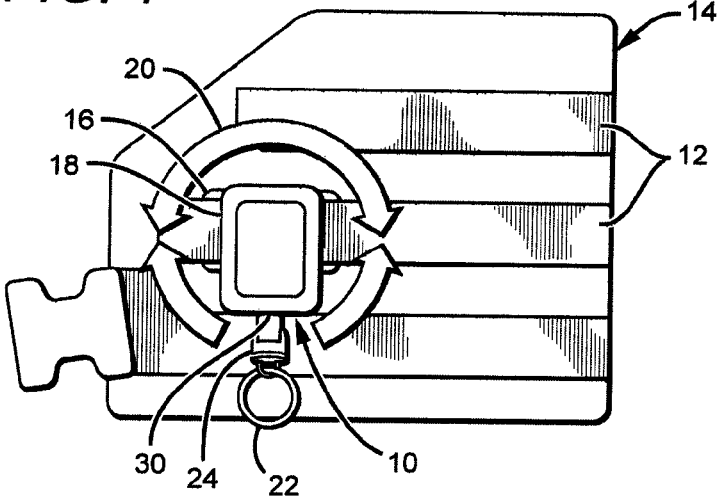
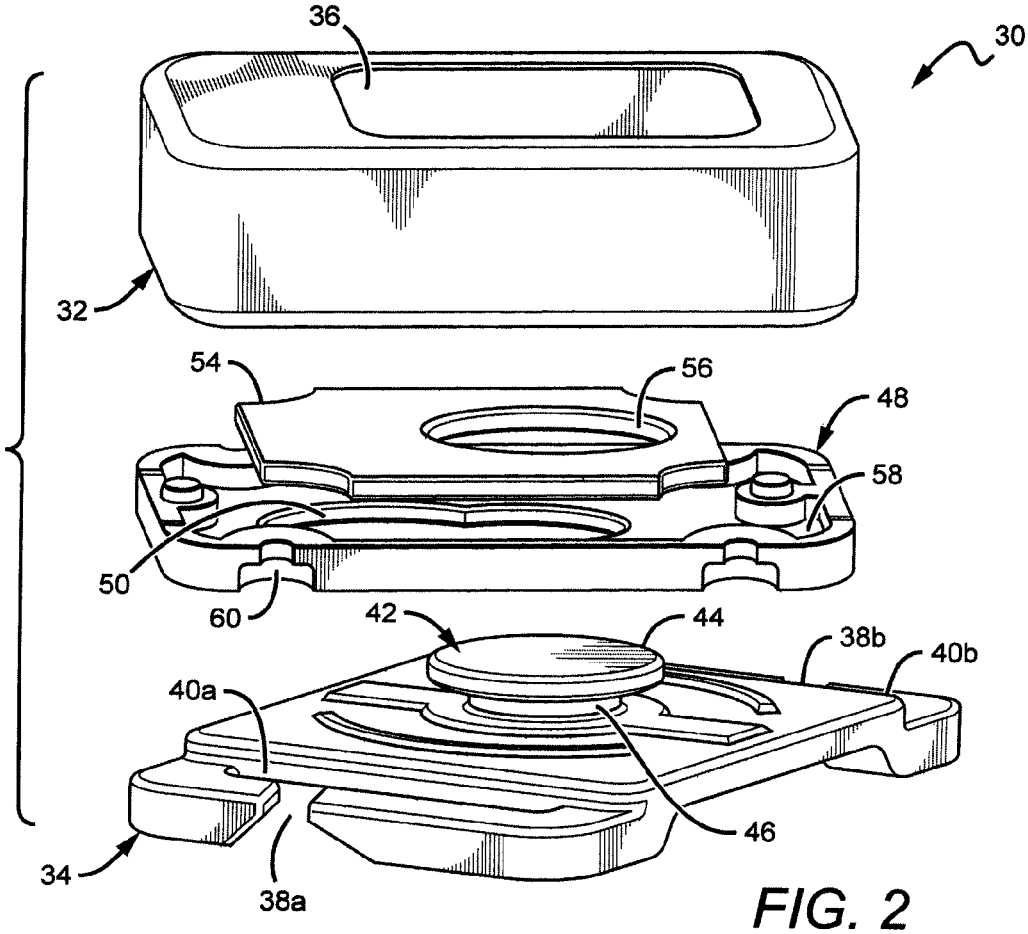
FIG. 2

RETRACTING DEVICE FOR MOUNTING TO A WEB STRAP

This application claims the benefit of U.S. Provisional Patent Application Ser. No. 61/587,047, filed on Jan. 16, 2011,

BACKGROUND OF THE INVENTION

1. Field of the Invention

Present invention is directed toward the attachment of retracting device to a web strap or MOLLE system found on Military and Tactical vests.

2. Description of the Related Art

Retractable Tethering Devices currently are being attached to a person through use of common art attachment mechanisms such as Snap Clips, Velcro Straps, Pin Mounting Systems, Bracket Mounting devices and Belt Clipping devices. Examples of these retractable devices can be seen in U.S. Pat. No. 6,966,519, U.S. Pat. No. 7,478,776, and U.S. Pat. No. 7,665,684, all to Salentine and Collin, and all assigned to Hammerhead Industries, Inc., the same assignee as the present application.

The MOLLE vest system was first introduced around 1997, but it did not see widespread use until after the Sep. 11, 2001 attacks when it was used by U.S. troops serving in Afghanistan and, later, Iraq. MOLLE (pronounced MOLLY as in the female name) is an acronym for MOdular Lightweight Load-carrying Equipment. It is used to define the current generation of load-bearing equipment and rucksacks utilized by the United States armed forces, especially the United States Army, and its use is also growing in the British Army in the form of the Osprey Modular systems. The system's modularity is derived from the use of Pouch Attachment Ladder System (PALS) webbing, which can comprise a grid of grid of webbing used to attach smaller equipment onto load-bearing platforms, such as vests and backpacks. It was first used on MOLLE rucksacks, but is now found on a variety of tactical equipment, such as the American Improved Outer Tactical Vest, Interceptor body armor, USMC Improved Load Bearing Equipment backpack and Modular Tactical Vest. It is used to attach items such as holsters, magazine pouches, radio pouches, knife sheathes, and other gear. A wide variety of pouches are commercially available, allowing soldiers to customize their kit. This method of attachment has become a standard for modular tactical gear, replacing the click and stick system used in the earliest modular vest systems (which is still in use with most Western police departments).

For some military and tactical applications, a Velcro strap that loops can be used to attach accessories, with the strap cinches around the web strap of the MOLLE system on tactical vests. In other arrangements, snap clips are used. Both of these mount systems allows for the retracting device to pivot from the person's body in the extended direction of the gear, thereby minimizing line/cable wear and resistance. One disadvantage of the above listed mounting systems is that the retracting device is hung from the mounting position, and may have an undesirable dangle length and excessive movement of the gear when not in use. These systems may require further mechanisms to further secure the gear to the person.

A rotating mount, such as a rotating belt clip is desirable from minimizing the dangle length of the retractor and undesirable movement of the gear when not in use. The disadvantage of most belt clip mounting systems is that they are not secure enough for the extreme tactical environment so as not to come dislodged.

Further, any such mount that is semi-permanently affixed, usually takes too much time and effort to install or remove. A disadvantage of current art belt clipping devices is that they restrict the ability for the retracting device to pivot in the direction of cable extension, thereby causing excessive resistance and cable flexing or fatigue which results in reduced overall life of the product.

Belt Clipping, pinning and Bracketing Systems are desirable to reduce the dangle length and gear movement. However, if they are a fixed mount with no rotating feature they will cause excessive line/cable wear and resistance when using the gear away from the body. Furthermore, due to the design of the MOLLE system, most of these mounts if they are easy to install are not secure enough or they are simply too difficult to install.

SUMMARY OF THE INVENTION

The present invention is generally directed to a retractor that is capable of mounting to a user, and has a housing that allows for rotation of the retractor housing about the retractor's attachment mechanism. More particularly the present invention is directed to retractors and vests having the retractors, wherein the retractor can be attached by an attachment mechanism to a web system on the vest. An accessory can be attached to a line within the retractor, and the user can extend the line from the retractor housing when the accessory is in use. When the line is extended from the housing, the retractor housing rotates so it is in alignment with the extended line. This alignment of the housing and line significantly reduces the stresses on the line, which in turn extends the reliability and lifespan of the retractor. Further, the line can be under have a retraction force that retracts the line back into the retractor housing when the extension force is released. The retraction force can be strong enough to prevent the line from extending from under weight of the accessory. The retractor can also minimize the dangle length of the retracting device to the attachment point to minimize movement when not in use.

One embodiment of a retractor according to the present invention comprises a retractor housing an attachment mechanism for attaching to directly to a web strap, wherein the attachment mechanism is coupled to the retractor housing, such that the housing can rotate about the attachment mechanism. A line is included that is capable of being extended and retracted from and back into the retractor housing, and a connector is on the line for connecting to an accessory.

Another embodiment of a retractor according to the present invention comprises a retractor housing and an attachment mechanism for attaching to a web strap. A rotation mechanism is included that cooperates with the housing and attachment mechanism to allow rotation of the housing about the attachment mechanism. A line is included capable of being extended and retracted from and back into the retractor housing.

On embodiment of a vest according to the present invention comprises a web strap system for the mounting of accessories to the vest and a retractor mounted to said web system. The retractor comprises a retractor housing an attachment mechanism for attaching to directly the web strap system and wherein the retractor housing is capable of rotating about the attachment mechanism. A line is included capable of being extended and retracted from and back into the retractor housing, and a connector is on the line for connecting to an accessory.

These and other further features and advantages of the invention would be apparent to those skilled in the art from the following detailed description, taken together with the accompanying drawings, in which:

BRIEF DESCRIPTION OF THE DRAWINGS

FIG. 1 is a front view of one embodiment of a retractable tether according to the present invention, mounted to a web strap;

FIG. 2 is a perspective exploded view of one embodiment of retractable tether according to the present invention;

DETAILED DESCRIPTION OF THE INVENTION

Figure 3:
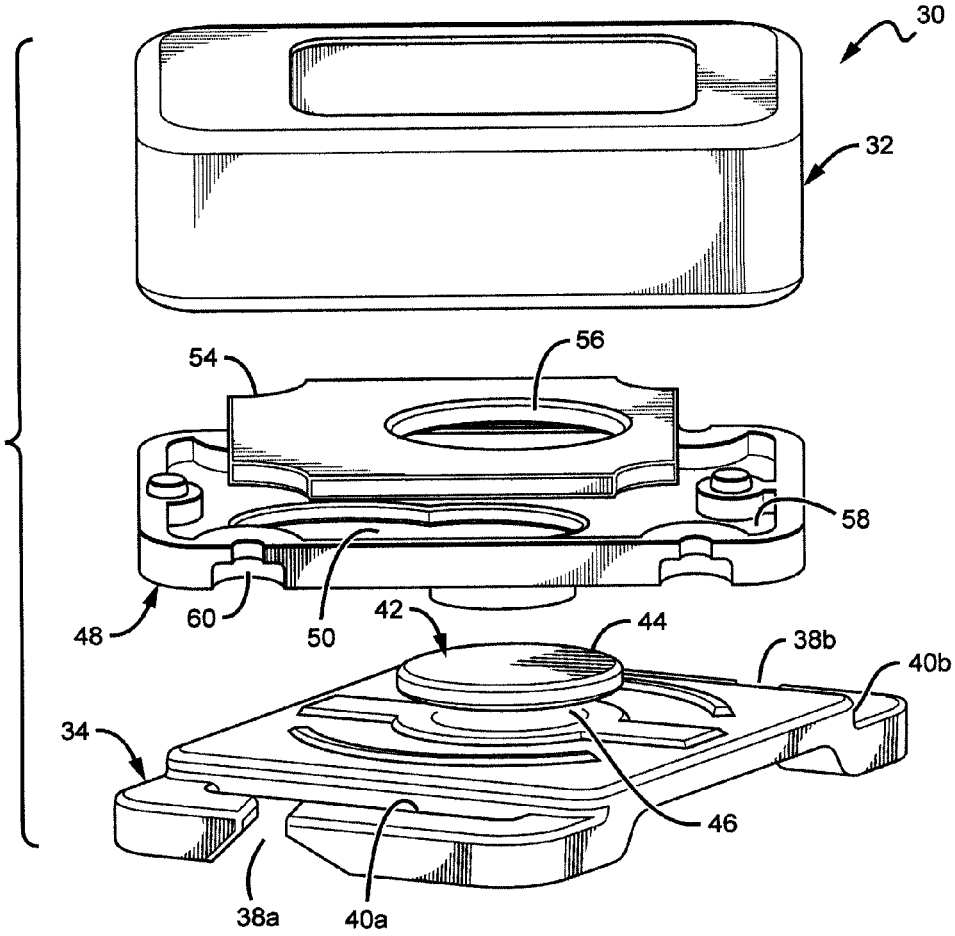
FIG. 3 is another perspective exploded view of the retractable tether shown in FIG. 2.

The present invention is directed to a rotating retractor that is arranged to be mounted on in many different locations and to many different articles of clothing. In particular, the present invention is adapted for mounting on vests, such as to a web strap provided on MOLLE type vests. In some embodiments, the present invention can be adapted for mounting to PALS webbing that can be found on a different types of vests, including MOLLE vests, but it is understood that the present invention can also be arranged to mount on many other types of mounting systems or webbing.

The retractors according to the present invention can be arranged with an attachment mechanism or connection point to reliably attach to a web strap or webbing system, and to allow for an accessory to be attached to a connector on the retractor. The attachment mechanism holds the retractor to the vest, while at the same time allowing for its quick and easy removal from the vest. The connector on the retractor can also be coupled to a line that can be extended from the retractor housing under a pulling force from, such as from the user. The line can then retract into the retractor housing when the pulling force is removed or released, with the connector preventing the line from fully retracting into the retractor housing. The retractor also comprises a rotation mechanism that allows for the retractor about the connection point. The different retractors can be arranged to rotate with different ranges about the connection point, with some embodiment having ranges up to 180°. Other embodiments can have rotation ranges up to 270°, while others can allow for a full rotation of 360° about the connection point. The rotation of the retractor housing allows for the line of the retractor to align with extended line to reduce stress, wear and tear on the extended line.

The present invention is described herein with reference to certain embodiments, but it is understood that the invention can be embodied in many different forms and should not be construed as limited to the embodiments set forth herein. It is further understood that different embodiments can comprise different materials arranged in different ways, and can comprise different features. Different embodiments can also be arranged for mounting to different types of apparatus beyond vests, and can be arranged to attach to different features of the vests.

It will be understood that when an element is referred to as being "on" or "in contact with" another element, it can be directly on, or in contact with the other element or intervening elements may be present. In contrast, when an element is referred to as being "directly on", or "directly in contact with" another element, there are no intervening elements present. Although the terms first, second, etc. may be used herein to describe various elements, and/or sections, these elements and/or sections should not be limited by these terms. These terms are only used to distinguish one element, or section from another element, or section. Thus, a first element or section discussed herein could be termed a second element, or section without departing from the teachings of the present invention.

Embodiments of the invention are described herein with reference to perspective view illustrations that are schematic illustrations of an embodiment of the invention. As such, the actual thickness of components can be different, and variations from the shapes of the illustrations as a result, for example, of manufacturing techniques and/or tolerances are expected. Embodiments of the invention should not be construed as limited to the particular shapes as illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

FIG. 1 shows one embodiment of a rotating retractor 10 according to the present invention, mounted to web strap 12 such as those provided on MOLLE vest system 14. The retractor 10 provides a coupling mechanism 16 (or connection point) that can be used for connecting to the user, and in the embodiment shown is compatible with the web strap on the vest system 14, and holds the rotating mechanism securely to the vest system 14. It is understood that many different coupling mechanisms can be used in different embodiments, with only two of the many different alternatives being described below.

The retractor 10 comprises a rotation mechanism (also described below) that allows the retractor body 18 to rotate about the coupling mechanism 16 as shown by arrows 20. As mentioned above, the retractor body 18 can rotate about connection point through different rotation ranges, with the embodiment shown having a retractor body 18 that rotates a full 360° about the coupling mechanism 18.

The retractor 10 can also comprise a connector having an attachment ring 22 for holding an accessory, and a quick release mechanism 24 that securely holds the accessory to the retractor 10, but can also be operated by the user for disengaging the accessory from the retractor 10. The retractor 10 can be arranged to hold many different accessories, including but not limited to a flashlight, laser pointer, medic shear, compass, handgun, knife, GPS, FRS radio and other electronic devices. It is understood that these are only some of the many accessories that can be attached to a web strap using the retractors according to the present invention.

FIGS. 2 and 3 show another embodiment of a rotating retractor 30 according to the present invention, comprising a housing 32 and a coupling mechanism 34. The housing 32 houses the line/tether ("tether") that protrudes from the housing through opening 36 (also shown in FIG. 1). The housing 32 can also include an internal mechanism that biases the tether to retract back into the housing 32. Many different biasing mechanisms can be used, with some embodiment utilizing a spring. The quick release mechanism 24 (shown in FIG. 1) can be attached to the end of the tether to prevent the tether from fully retracting into the housing 32. The tether can be pulled and extended from the housing 32 by the user against the bias of the internal biasing mechanism, and automatically retracts into the housing 32 when the pulling force is released. Tethers of different length can be used, with one embodiment having a tether that extends approximately 36 inches from the housing 32. The internal spring can have different levels of retraction force, with one embodiment having a retraction force of approximately 6 ounces. Other embodiments can have a lower retraction force, while still other embodiments can have a greater retraction force, such as 12 or 18 ounces, or more.

The coupling mechanism 34 is designed to cooperate with a web strap to reliably hold the retractor to the web strap. In the embodiment shown, the coupling mechanism comprises first and second strap notches 38*a*, 38*b*, and first and second strap slots 40*a*, 40*b*. A web strap can be fed through each of the notches 38*a*, 38*b* until it is allowed to expand and substantially fill the one of its slots 40*a*, 40*b*, with the web strap running behind the coupling mechanism 34. This arrangement securely holds the coupling mechanism 34 to the web strap.

The coupling mechanism is also arranged to allow for rotation of the retractor housing, and different embodiment can have different features to allow for this rotation. Retractor 10 comprises a coupling mechanism 34 having a mushroom shaped post 42, with larger diameter upper section 44, and smaller diameter lower section 46. The present invention also comprises a rotation mechanism 48 that is arranged to cooperate with the coupling mechanism 34 to allow the housing 32 to rotate about the coupling mechanism 34. The rotation mechanism has a slot 50 with a larger diameter section sizes for the post's larger section 46 to pass, and a smaller section sized for the post's smaller diameter section 48 to fit. During assembly of the retractor 30, the post's larger section 46 can be inserted through the slot's larger diameter portion, and the rotation mechanism is slid such that the post's smaller section 48 is in the slot's smaller section. This engages the rotation mechanism 48 with the coupling mechanism 34, with the mounting mechanism 48 rotating about the coupling mechanism 34 on the post 42.

To hold the post 42 in the desired position in the slot 50, a holding plug 54 is included that is sized to fit in the cavity 58 of the rotation mechanism 48. The plug 50 has a post hole 56 sized and positions to hold the posts larger section 46 when the post is in the desired position in the slot 50. The holding plug 54 can then be bonded or mounted to the rotation mechanism 48, with the coupling mechanism 34 mounted to the rotation mechanism 48. The rotation mechanism 48 can then be bonded or mounted to the housing 32 using many different methods or mechanisms. In the embodiment shown, the mounting mechanism 48 is mounted to the housing screws (not shown) that pass through four screw holes 60.

Figure 4:
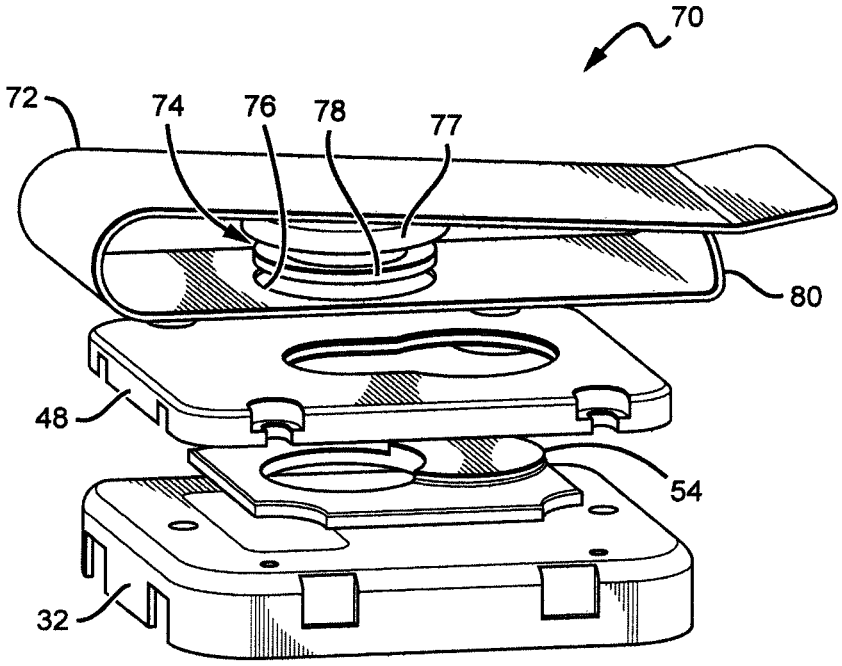
FIG. 4 is a perspective exploded view of another embodiment of retractable tether according to the present invention.
Figure 5:
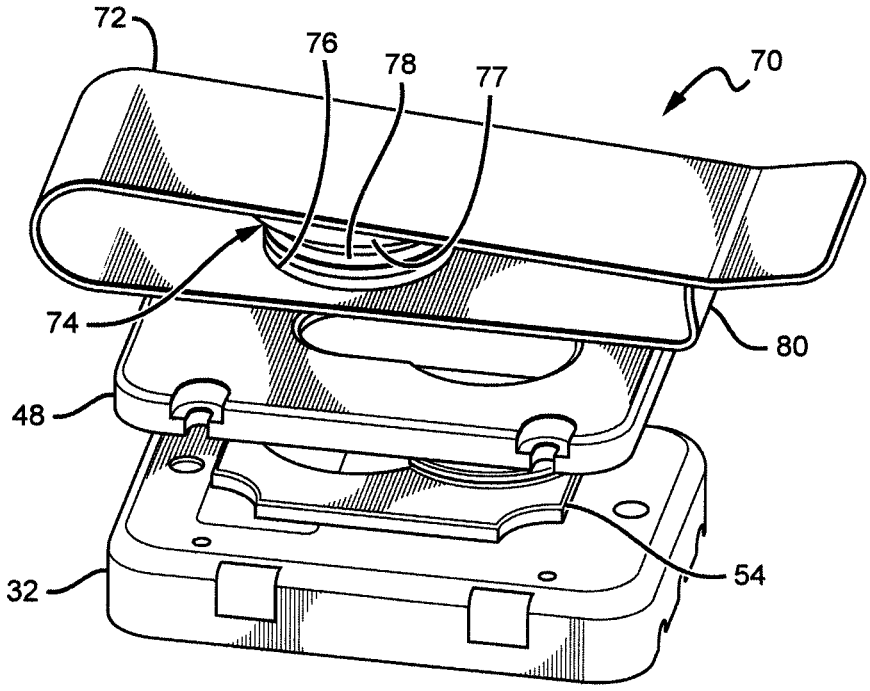
FIG. 5 is another perspective exploded view of the retractable tether shown in FIG. 4.

FIGS. 4 and 5 show still another embodiment of a rotating retractor 70 according to the present invention that is similar to the retracting tether 30 above, and for similar features that same reference numbers will be used. The retractor 70 comprises a housing 32, rotation mechanism 48 and holding plug 54. This embodiment, however, comprises a different mounting mechanism in the form of a U-shaped belt clip 72. The belt clip 72 comprises a post 74 that passes through a belt clip hole 76 to engage and cooperate with the rotation mechanism 48 as described above. The post 74 comprises a larger diameter upper section 77 and lower diameter lower section 78, and is held in place by the holding plug 54 as described above. The belt clip is designed to hold a web strap, with the end tab 80 helping to retain the web strap.

While different embodiments of the invention have been shown and described, numerous variations and alternate embodiments will occur to those skilled in the art, such as utilizing the present invention for attaching to many different devices and for use with many different accessories. Such variations and alternate embodiments are contemplated, and can be made without departing from the spirit and scope of the invention as described herein.

We claim:

1. A retractor, comprising:

a retractor housing;

an attachment mechanism for attaching directly to a web strap, wherein said attachment mechanism is coupled to said retractor housing, and wherein said housing can rotate about said attachment mechanism, wherein said attachment mechanism comprises a slotted rotation mechanism;

a post comprising an upper section and a lower section, wherein said post is coupled to said attachment mechanism, and wherein said slotted rotation mechanism cooperates with said post;

a line capable of being extended and retracted from and back into said retractor housing; and a connector on said line for connecting to an accessory;

wherein said slotted rotation mechanism comprises a slot, said slot comprising a larger diameter section and a smaller diameter section, said larger diameter section comprising a diameter larger than the diameter of said upper section of said post.

2. The retractor of claim 1, wherein said web strap is part of a vest.

3. The retractor of claim 1, wherein said strap is part of a MOLLE vest.

4. The retractor of claim 1, wherein said strap is part of a Pouch Attachment Ladder System (PALS) webbing system.

5. The retractor of claim 1, wherein said line is capable of extending from said retractor housing under a pulling force from said user.

6. The retractor of claim 5, wherein said retractor housing is capable of rotating about said attachment mechanism so that said housing is in alignment with said extended line.

7. The retractor of claim 1, wherein said line is capable of retracting back into said housing when said pulling force is released.

8. The retractor of claim 1, wherein said connector prevents said line from being fully retracted into said housing.

9. The retractor of claim 1, wherein said connector comprises a quick release mechanism.

10. The retractor of claim 1, wherein said connector comprises a ring.

11. The retractor of claim 1, wherein said attachment mechanism comprises one or more notches sized for a web strap to pass through.

12. The retractor of claim 11, wherein said attachment mechanism further comprises a slot to hold said web strap after it passes through said one or more notches.

13. The retractor of claim 1, further comprising a slotted rotation mechanism coupled to said housing and cooperating with said attachment mechanism to allow for rotation of said housing about said attachment mechanism.

14. A retractor, comprising:

a retractor housing;

an attachment mechanism for attaching to a web strap;

a post comprising an upper section and a lower section, wherein said post is coupled to said attachment mechanism;

a slotted rotation mechanism cooperating with said post and said attachment mechanism to allow rotation of said housing about said attachment mechanism, wherein said slotted rotation mechanism comprises a slot, said slot comprising a larger diameter section and a smaller diameter section, said larger diameter section comprising a diameter larger than the diameter of said upper section of said post; and a line capable of being extended and retracted from and back into said retractor housing.

15. The retractor of claim 14, further comprising a connector on said line for connecting to an accessory.

16. The retractor of claim 14, wherein said slotted rotation mechanism is arranged between said housing and said attachment mechanism.

17. The retractor of claim 14, wherein said slotted rotation mechanism is attached to said housing.

18. The retractor of claim 14, wherein said slotted rotation mechanism comprises a plug and slot, wherein said plug is arranged to hold said post in the desired position within said slot.

19. The retractor of claim 14, wherein said retractor housing is capable of rotating about said attachment mechanism so that said housing is in alignment with said line when said line is extended from said housing.

* * * * *